United States Patent [19]

Holmes

[11] Patent Number: 4,830,270

[45] Date of Patent: May 16, 1989

[54] MAILING AND SHIPPING CARTON

[75] Inventor: Gordon W. Holmes, Toronto, Canada

[73] Assignee: Professional Packaging Limited, Toronto, Canada

[21] Appl. No.: 195,773

[22] Filed: May 19, 1988

[51] Int. Cl.[4] ..... B65D 5/02

[52] U.S. Cl. ..... 229/102; 206/807; 229/150; 229/153

[58] Field of Search ..... 229/102, 142, 150–153; 206/807

[56] References Cited

U.S. PATENT DOCUMENTS

| | | | |
|---|---|---|---|
| 1,852,527 | 4/1932 | King | 229/142 |
| 2,481,288 | 9/1949 | Cage | 229/142 |
| 3,126,140 | 3/1964 | Lizan et al. | 229/150 |
| 3,165,253 | 1/1965 | Adams et al. | 229/150 |
| 3,451,535 | 6/1969 | Caplan | 229/102 |
| 4,063,678 | 12/1977 | Hall | 206/807 |
| 4,535,929 | 8/1985 | Sherman, II et al. | 206/807 |
| 4,674,676 | 6/1987 | Sandel et al. | 229/142 |
| 4,746,052 | 5/1988 | Schmissrauter | 206/807 |

FOREIGN PATENT DOCUMENTS

| | | | |
|---|---|---|---|
| 583414 | 9/1959 | Canada . | |
| 656981 | 1/1963 | Canada . | |
| 690233 | 7/1964 | Canada . | |
| 812099 | 5/1969 | Canada . | |
| 2504892 | 11/1982 | France | 206/807 |

*Primary Examiner*—Gary Elkins

*Attorney, Agent, or Firm*—Sim & McBurney

[57] ABSTRACT

A mailing and shipping container is described which is of rigid construction and simple design and which, once closed, resists opening without destroying the integrity of the structure. The container comprises a tubular sleeve generally of rectangular cross section and end closures at the ends. The end closures comprise overlying panels which have interacting tabs and slots and means for preventing the tabs from being withdrawn from the respective slots after insertion therein.

6 Claims, 4 Drawing Sheets

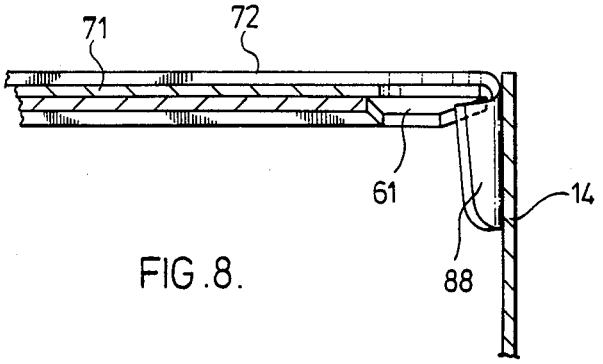
FIG. 8.
FIG. 9.
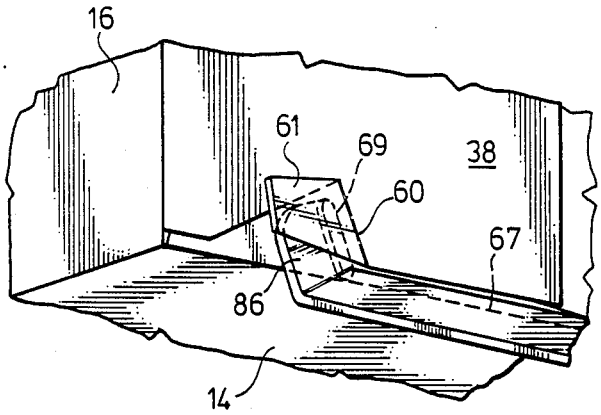
FIG. 10.
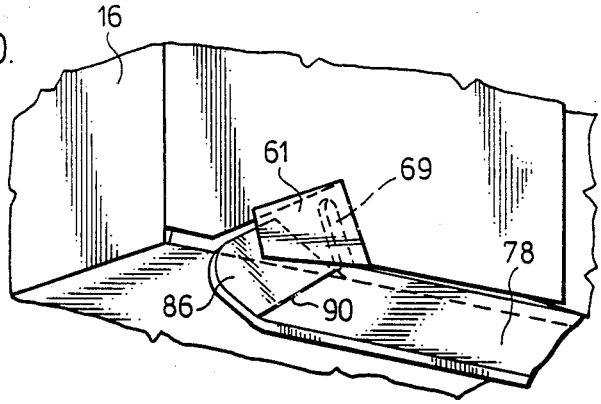

MAILING AND SHIPPING CARTON

FIELD OF INVENTION

The present invention relates to a mailing and shipping carton which is rugged in construction, simple in design and, once closed, resists opening without destroying the integrity of the structure.

BACKGROUND TO THE INVENTION

A variety of items are shipped from one location to another in a variety of packages. One of the major problems which arises in such activity is the inadequate packaging often used by the sender, leading to lost, stolen and damaged goods. An added cost burden is placed on the shipper for repackaging of damaged packages resulting from the rigours of the largely mechanized handling systems often employed by many shippers, such as Canada Post.

SUMMARY OF INVENTION

The present invention provides an improved manner of shipping items in a secure manner which resists damage and pilferage. The present invention provides a mailing or shipping carton which lies flat in unassembled form and which is folded to form a tubular container with two open ends generally of rectangular cross section and has two end closures which have interlocking elements which close and secure the ends.

In accordance with the present invention, there is provided a mailing and shipping container comprising a tubular sleeve of generally rectangular cross-section and two end closures for closing each of the ends of the tubular sleeve and to prevent opening of the container to gain access to the interior thereof without destroying the integrity of the container.

Each end closure comprises overlying panels each of substantially the same dimension as the end closure of the tubular sleeve, one of the overlying panels being hingedly joined to one longitudinal edge of the end opening of the sleeve and has tab means hingedly joined to the other edge thereof, the other of the overlying panels being hingedly joined to the other longitudinal edge of the sleeve and has tab-receiving slot means formed therethrough adjacent its hinged join for receiving the tab means therein.

The tab means comprise a first tab portion hingedly joined to the one panel and second tab portions hingedly joined to each longitudinal end of the first tab portion, the slot means comprising a first elongate portion parallel to the hinged join and having a length substantially that of the first tab portion and second portions extending one from each longitudinal end of the first elongate portion at an angle thereto for a distance slightly less than the longitudinal dimension of the second tab portions.

Means is provided for deflecting the second tab portions out of alignment with the second tab portions after the second tab portions have passed through the second slot portions upon formation of the end closure.

By employing this cooperating tab and slot arrangement and means for deflecting the tab, a secure, pilferproof container can be provided.

The product to be shipped is simply placed in the container and the ends are securely closed. The address and postage are applied and the resulting package is ready for shipment by post office, courier or other selected means. The container is able to accept a variety of products of differing size and internal packing may be used to minimize damage caused by the item impacting against the internal wall of the container. The container is particularly useful for odd shaped items, which are usually difficult to wrap adequately for trans-shipment.

BRIEF DESCRIPTION OF DRAWINGS

FIGS. 6 to 8 are sectional views taken on line A—A of FIG. 5 illustrating the locking of the tabs of the end closure of the shipping container of FIGS. 2 to 5; and FIGS. 9 and 10 are detail internal views also illustrating the interaction of the locking tabs upon closure of the ends of the container of FIGS. 2 to 5.

DESCRIPTION OF PREFERRED EMBODIMENT

Figure 1:
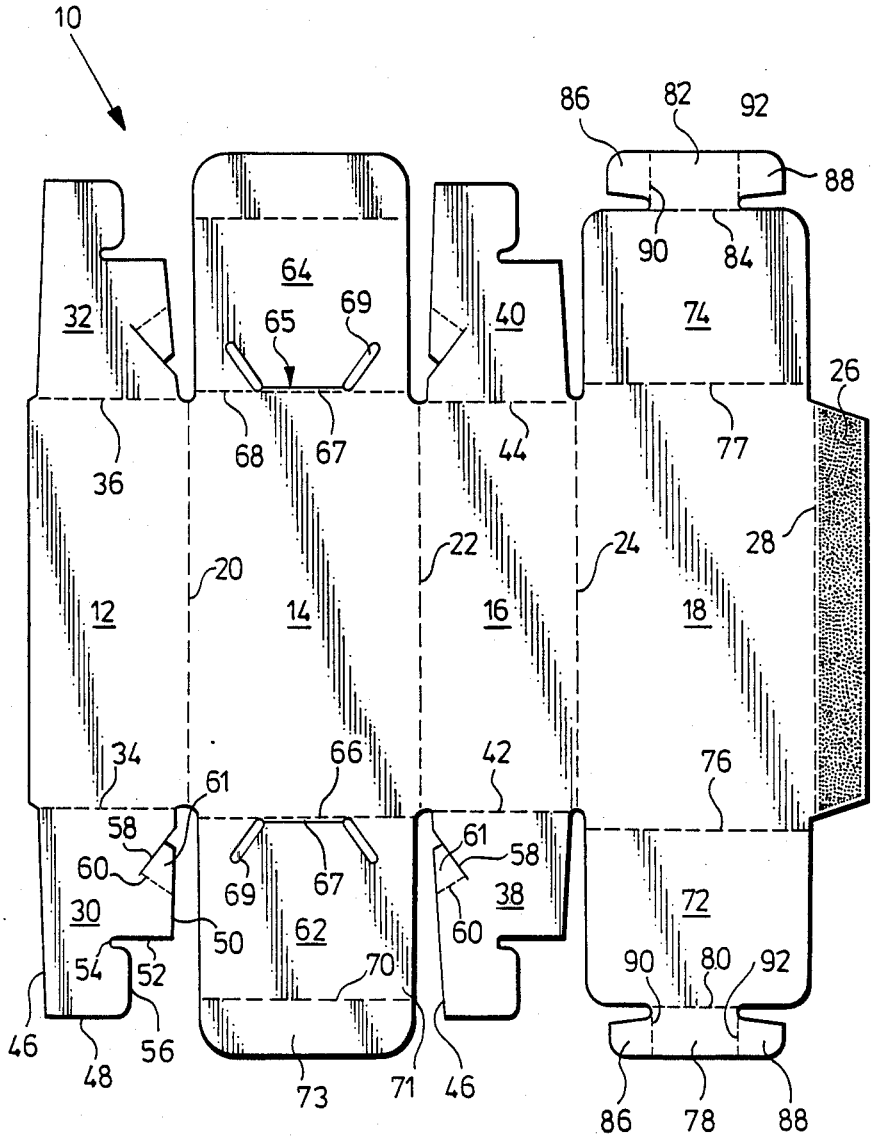
FIG. 1 is a plan view of a blank from which a mailing and shipping container according to one embodiment of the invention may be assembled.

Referring to the drawings, a blank 10 for a mailing and shipping container comprises four main rectangular panels 12, 14, 16 and 18 which constitute the side walls of the container, when assembled. Panels 12 and 16 have substantially the same dimensions as do panels 14 and 18.

Panel 12 is joined at one longitudinal side edge to one longitudinal side edge of panel 14 through fold line 20 and has a free longitudinal side edge. The other longitudinal side edge of panel 14 is joined to one longitudinal side edge of panel 16 by fold line 22. The other longitudinal side edge of panel 16 is joined to one longitudinal side edge of panel 18 through fold line 24. The other longitudinal side edge of panel 18 is joined to a gluing tab 26 through fold line 28.

The blank 10 usually is constructed of corrugated board, preferably with the corrugations extending at right angles to the fold lines 20, 22, 24 and 28. Any other suitable foldable die-cuttable stiff damage resistant material may be employed. The blank 10 is formed by die-cutting from sheets of construction material.

When the panels 12, 14, 16 and 18 are folded about fold lines 20, 22 and 24, a tubular enclosure is formed which is completed by adhesively joining glue tab 16 to the inside face of panel 12 with the fold line 28 coinciding with the free longitudinal edge of panel 12.

The panels 12, 14, 16 and 18 are joined to end panels at each lateral side edge thereof. Panel 12 is joined to panels 30 and 32 through fold lines 34 and 36 respectively while panel 16 is joined to panels 38 and 40 through fold lines 42 and 44. The members of each pair of panels 30, 32 and 38,40 have mirror-image shapes while the panels 30 and 38 and panels 32 and 40 have substantially the same outline, except as noted below.

The panel 30 has a straight side edge 46 extending for the length of the panel 30 and slightly tapering towards the outboard end of the panel which is defined by a transverse straight edge 48 generally parallel to the fold line 34. The panel 30 also has a straight side edge 50 also slightly tapering and terminating in a transverse edge 52 which extends towards the side edge 46 to terminate in a notch 54. An inwardly directed edge 56 extends from the outer edge 48 towards the fold line 34 to terminate in the notch 54. A diagonal cut 58 is formed in the panel 30 extending from adjacent the join of the fold line 34 and the edge 50 away from the fold line 34 and towards the side edge 46. A diagonal fold line 60 extends from the inboard extremity of the cut line 58 to the side edge 50 to define a triangular tab 61 with the cut 58.

As noted earlier, flap 38 is similarly-shaped to flap 30 and flap 40 is similarly-shaped to flap 32, the exception being that, in respect of flaps 38 and 40, the diagonal cut 58 is formed extending from the side edge 46 and the fold line 60 extends from the inward extremity of the cut 58 to the side edge 46.

The overall longitudinal dimensions of the flaps 30, 32, 38 and 40 are such that, when the panels 12, 14, 16 and 18 are folded to form a tube, flaps 32 and 40 overlap and flaps 30 and 38 overlap with the notches 54 substantially in alignment to permit them to interlock one with another.

The panel 14 is joined to end panels 62 and 64 through fold lines 66 and 68 respectively. Each of end panels 62 and 64 has the same generally rectangular shape and is provided with a transverse fold line 70 parallel to fold line 66 or 68. The fold lines 66, 70 and 68, 70 define rectangular panels 71 dimensioned substantially the cross sectional dimension of the end opening of the tube formed upon folding the panels 12, 14, 16 and 18 and a tab 73 in the outer region of the panel.

The panels 62 and 64 each has a slot 63 and 65 respectively formed therethrough which includes an elongate portion 67 adjacent and parallel to the fold lines 66, 68 and two diagonal portions 69 extending diagonally from the ends of the elongate portion 67 across the respective panel 62 towards the adjacent side wall.

The panel 18 is joined to end panels 72 and 74 through fold lines 76 and 77 respectively. Each of the end panels 72 and 74 is of generally rectangular shape and dimensioned substantially the cross sectional dimension of the end opening of the tube formed upon folding the panels 12, 14, 16 and 18. End panel 72 has a tab 78 joined to its outboard edge through fold line 80 while end panel 74 has a tab 82 joined to its outboard edge through fold line 84. The fold lines 80 and 84 extend for approximately one-third of the lateral dimension of the panels 72 and 74 respectively and correspond in length substantially to the longitudinal dimension of the elongate slots 67 formed through panels 62 and 64.

Each of the tabs 78 and 82 has a pair of ear tabs 86, 88 joined to the tabs 78, 82 by fold lines 90 and 92 respectively. The ear tabs 86, 88 have a longitudinal dimension measured from the fold lines 90, 92 slightly greater than the diagonal cuts 69 formed in the panels 62 and 64.

As noted earlier, folding of the panels 12, 14, 16 and 18 about the fold lines 20, 22 and 24 form an elongate tube which is secured by gluing tab 26 to panel 12. The resulting tube can be folded flat for shipment and storage at the point of use.

Figure 2:
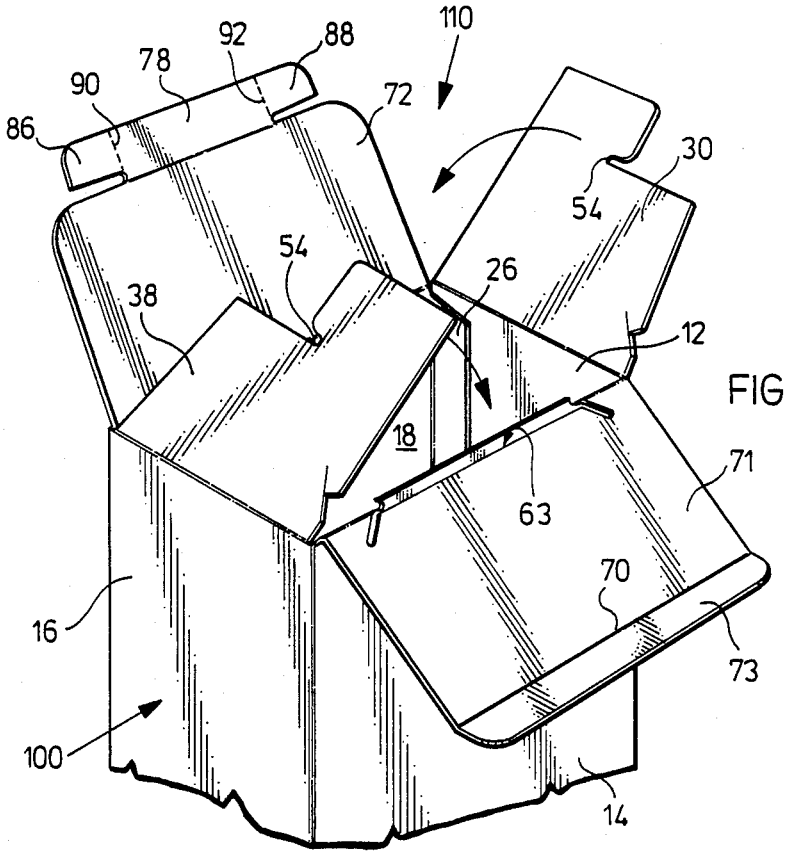
FIGS. 2 to 5 are perspective views of a mailing and shipping container constructed in accordance with one embodiment of the invention illustrating the steps of assembly of one end closure.

When required to be used for mailing or shipping items, the tube form is restored by folding about the fold lines 20, 22, 24 and 28 to provide a rectangular opening at both ends with the panels 14 and 18 parallel to one another and panels 12 and 16 parallel to one another. The remaining panels then are folded to form end closures, to provide a mailing and shipping container 100 (FIGS. 2 and 3).

Figure 3:
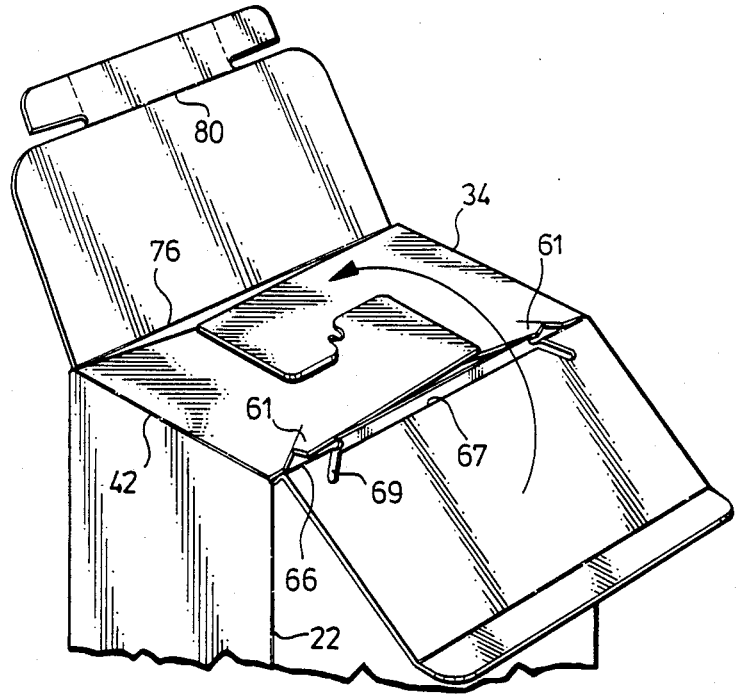

FIGS. 2 to 5 illustrate the assembly of the structure of one end closure 110 formed from the panels 30, 38, 62 and 72 illustrated in FIG. 1 but it will be understood that the end closure formed at the other end of the container 100 is identical to the illustrated end closure 110 and is formed from panels 32, 40, 64 and 74. The end closure 110 is formed from an open-ended container 100 (FIG. 2) first by interlocking the panels 30 and 38 by inserting the notches 54 one with another so that the panels overlap and overlie each other adjacent the notches (FIG. 3).

Figure 4:
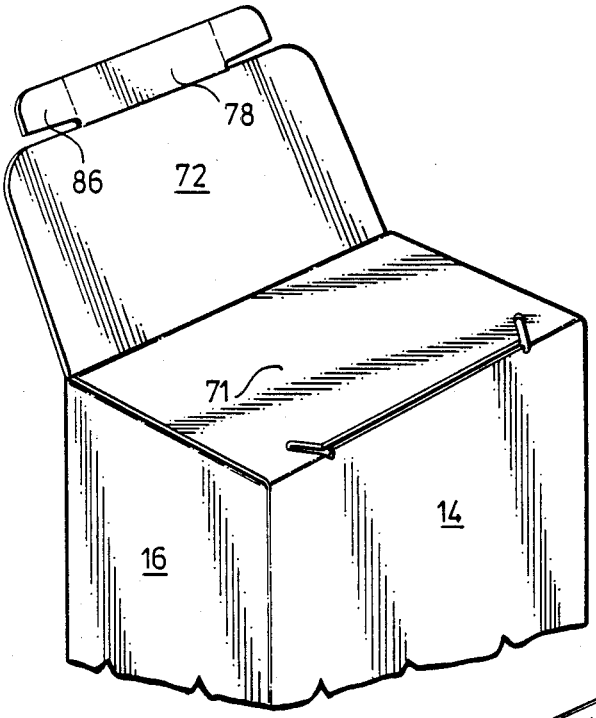
Figure 5:
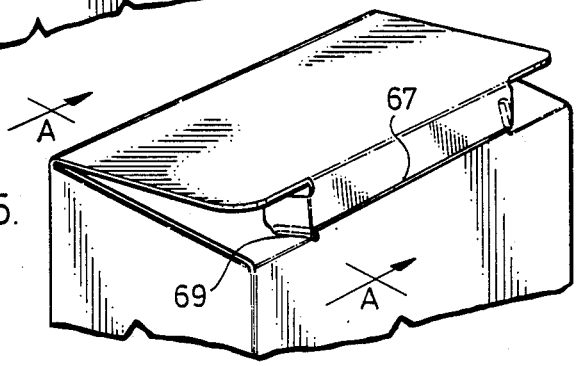

The panel 62 then is folded about fold line 66 so that panel portion 71 overlies the interlocked panels 30 and 38 and the tab 73 is tucked between the side edges of the interlocked panels and the hinge line 76 (FIG. 4). Next, the panel 72 is folded about hinge line 76 to overlie the panel 62. To complete the closure, the tab 78 is inserted through the elongate slot 67 while the ear tabs 86 and 88 are pushed through the slots 69 (FIG. 5). The ear tabs 86 and 88 are slightly longer than the slots 69, so that positive pressure must be applied to cause them to pass through the slots.

Figure 6:
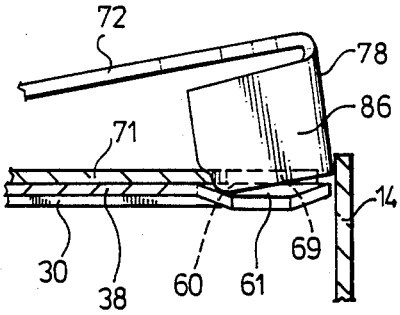
Figure 7:
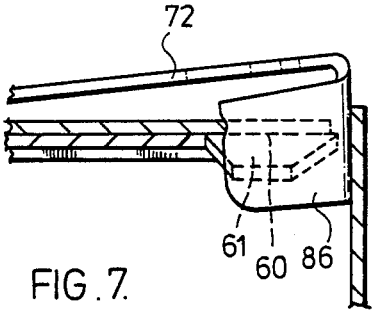

As the ear tabs 86 and 88 project through the slots 69, they deflect the triangular tabs 61 about the hinge lines 60 (FIGS. 6, 7 and 9). Once the ear tabs 86 and 88 pass through the slot 69 and out of interference engagement therewith and the panel 72 is in engagement with the panel 71, the tension created in triangular tabs 61 by their deflection about hinge line 60 is released by the triangular tab 61 deflecting the ear tabs 86, 88 about the hinge lines 90 and 92 and out of alignment with the slots 69. The deflection of the ear tabs 86 and 88 in this way ensures that they cannot be withdrawn back through the slot 69, but rather are in interference engagement with the underside of the panel 62 (FIGS. 8 and 10). The end closure 110 is now locked and cannot be opened without destroying the integrity of the overall structure.

The mailing and shipping container 100 is of rugged construction and is able to withstand the rigours of the handling operations to which the container will be subject prior to delivery. The use of corrugated card imparts impact resistance to the structure. Three layers of material are provided at each of the ends and preferably the corrugations travel at right angles to the tube fold lines 20, 22, 24 and 28, which adds considerably to the stacking strength of the container. The interlocked panels 30 and 38 inhibit outward bulging of the side walls 12 and 16 under a heavy end load.

The deflection of the ear tabs 86 and 88 in the slots 69 ensures that the container 100 does not open accidentally in transit and also prevents ready access to the contents of the container. Undetected pilferage is not possible, since the integrity of the structure needs to be destroyed to gain access to the interior of the container 100.

The mailing and shipping container 100 is simple to fill with the desired object or objects to be mailed or shipped and is also simple to close. Since the end closures are locked by interaction of the tabs and the slots, the final package needs no additional securement means, such as glue, adhesive tape or string, to secure the final package for shipment.

SUMMARY OF DISCLOSURE

In summary of this disclosure, there is provided a mailing and shipping container which is simple in construction and use and yet has considerable durability and resists pilferage. Modifications are possible within the scope of this invention.

What I claim is:

1. A mailing and shipping container, comprising:

a tubular sleeve of generally rectangular cross-section and having two ends and an opening at each end and two end closures for closing each of the ends of the tubular sleeve to define with said sleeve an interior of said container and to prevent opening of the container to gain access to the interior thereof without destroying the integrity of the container, each end closure comprising overlying panels each of substantially the same dimension as the respective end opening of said tubular sleeves, one longitudinal edge of one of said overlying panels of each end closure being hingedly joined to one longitudinal edge of the respective end opening of said sleeve and said one panel of each end closure has tab means hingedly joined to another longitudinal edge thereof, one longitudinal edge of another of said overlying panels of each end closure being hingedly joined to another longitudinal edge of the respective end opening of said sleeve and said another panel of each end closure has tab-receiving slot means formed therethrough adjacent its hinged joint at said one longitudinal edge thereof for receiving said tab means therein, said tab means comprising a first tab portion hingedly joined to each said one panel and having longitudinal ends and a second tab portion hingedly joined to each said longitudinal end of said first tab portion by hinge lines, said slot means comprising a first elongate portion parallel to the hinged joint at said one longitudinal edge thereof and having longitudinal ends and a length substantially that of the first tab portion and a second portion extending from each said longitudinal end of said first elongate portion at an angle thereto for a distance slightly less than the longitudinal dimension of said second tab portions, and means located in the interior of said container for deflecting said second tab portions out of alignment with said second portions of said slot means after said second tab portions have passed through said second slot portions upon formation of said end closures.

2. The container of claim 1, wherein said end closures also include a pair of panels underlying said overlying panels, each underlying panel hingedly joined to one of two lateral side edges of one of the end openings of said sleeve, said pair of panels each includes a notch which interlocks with a corresponding notch on the other of said pair of panels to form a continuous substantially rigid structure substantially coextensive with the one end opening of the tubular sleeve, and said deflection means is provided on said pairs of panels.

3. The container of claim 2 wherein said deflection means comprises triangular tab means formed in and hingedly joined to each of said pair of panels by a hinge line and aligned with said second slot portions so that, as said second tab portions project through the second slot portions, said triangular tab means is hinged downwardly about its hinge line until said second tab portions have extended clear through the second slot portions, whereupon said triangular tab portions hinge upwardly and deflect said second tab portions about their hinge lines out of alignment with said second slot portions.

4. The container of claim 3 wherein said another of said overlying panels includes a tuck-tab at a longitudinal edge opposite to its hinged joint which extends between an edge of the second pair of panels and an adjacent side wall of the tubular sleeve.

5. The container of claim 1 constructed of corrugated cardboard material.

6. The container of claim 5 wherein the corrugations extend generally perpendicular to hinge lines joining constituent panels of the tubular sleeve.

* * * * *